United States Patent [19]

Liberman et al.

[11] 4,112,823

[45] Sep. 12, 1978

[54] METHODS AND APPARATUS FOR CONTROLLING AN HYDRAULIC CYLINDER

[75] Inventors: Harvey W. Liberman, Knoxville; James Stephen Whitehead, Maryville, both of Tenn.

[73] Assignee: Carrier Corporation, Syracuse, N.Y.

[21] Appl. No.: 641,370

[22] Filed: Dec. 17, 1975

[51] Int. Cl.[2] ..... F15B 21/02

[52] U.S. Cl. ..... 91/36; 91/35; 91/168; 91/189 R; 91/393; 91/471; 307/144

[58] Field of Search ..... 91/38, 393, 471, 35, 91/36, 168, 189; 137/624.13, 624.11; 214/310; 318/484; 60/387; 307/141, 144

[56] References Cited

U.S. PATENT DOCUMENTS

| | | | |
|---|---|---|---|
| 2,939,953 | 6/1960 | Parsons | 137/624.13 |
| 3,169,450 | 2/1965 | Köhl | 91/38 |
| 3,306,320 | 2/1967 | Bond | 137/624.13 |
| 3,502,269 | 3/1970 | Robertson | 137/624.13 |
| 3,552,253 | 1/1971 | MacDonald | 91/38 |
| 3,590,582 | 7/1971 | German | 91/35 |
| 3,737,143 | 6/1973 | Hodler | 91/38 |
| 3,872,876 | 3/1975 | Bachman | 91/38 |
| 3,889,415 | 6/1975 | Holmes | 137/624.11 |
| 3,965,797 | 6/1976 | Grisebach | 91/32 |

*Primary Examiner*—Martin P. Schwadron
*Assistant Examiner*—Abraham Hershkovitz
*Attorney, Agent, or Firm*—Burns, Doane, Swecker & Mathis

[57] ABSTRACT

Automated control apparatus for an intermittently extended hydraulic cylinder is disclosed which governs cylinder elongation such that the rate of elongation is essentially constant with respect to time. The control apparatus includes a preset continuously variable timer that regulates the timer interval between sequential length increments of the cylinder. The control apparatus also includes a second timer which is responsive to the timer interval interposed by the first timer and which operates a valve controlling communication of hydraulic fluid between a hydraulic cylinder and a pump. The second timer may be discretely variable so that one of a plurality of predetermined length increments can be selected. Alternatively, the second timer may adjust the time period during which the valve is opened such that successive stages of a telescopic hydraulic cylinder have equal length increments.

5 Claims, 6 Drawing Figures

METHODS AND APPARATUS FOR CONTROLLING AN HYDRAULIC CYLINDER

CROSS-REFERENCES TO RELATED APPLICATIONS

This application is related to the following copending and commonly assigned applications: "Method and Apparatus for Transferring Refuse" by Harvey W. Lieberman and John C. Salyers, Ser. No. 641,757, filed Dec. 17, 1975 now U.S. Pat. No. 4,044,905; "Method and Apparatus for Loading Refuse Into Containers" by Harvey W. Lieberman, Paul L. Goranson, R. Houston Ratledge, Jr. and John C. Salyers, Ser. No. 641,375, filed Dec. 17, 1975; "Method and Apparatus for Unloading Refuse Containers" by Harvey W. Lieberman, Samuel E. Harvey, J. Stephen Whitehead, and Paul L. Goranson, Ser. No. 641,524, filed Dec. 17, 1975; and "Refuse Container" by Donald J. Hopkins, John C. Salyers and Paul L. Goranson, Ser. No. 641,371, filed Dec. 17, 1975 now U.S. Pat. No. 4,044,914. Each of the above-identified applications is expressly incorporated herein by this reference thereto.

BACKGROUND OF THE INVENTION

This invention relates generally to methods and apparatus for controlling an hydraulic cylinder. More particularly this invention concerns methods and apparatus for controlling an intermittently extended hydraulic cylinder.

When handling materials having non-uniform size and heterogeneous composition, it is sometimes desirable to discharge the material from a container at an essentially uniform volumetric rate. In some instances, the container may be provided with a multi-stage hydraulic cylinder which extends into the container and pushes a bulkhead or platen that, in turn, presses against the material to expel it from the container.

When a multi-stage telescopic hydraulic cylinder is employed to discharge refuse material, the foregoing problems are compounded by the fact that successive stages of the cylinder extend at different rates when supplied with a constant volume flow of hydraulic fluid. Such variant rates of extension are especially problematic when one is trying to get an essentially uniform discharge of material with respect to time. While one manner of overcoming this disadvantage is to use a variable flow pump, variable flow pumps are substantially more expensive than constant flow pumps and are therefore undesirable where they can be avoided.

With a variable flow rate pump, the hydraulic cylinder may be provided with a control that accommodates different extension rates of successive stages and allows a low, but continuous, rate of extension as the cylinder presses against the bulkhead or platen. Such a continuous rate of elongation, however, still causes an erratic discharge of the container contents due to the non-uniformity and heterogeneity of the material.

An alternative to continuous elongation is pulsed elongation for the hydraulic cylinder. During pulsed elongation, an hydraulic cylinder may be cyclically extended a relatively short length increment at relatively high speed, and then stopped for a predetermined time. Pulsed intermittent elongation of an hydraulic cylinder may be effected by a manual operator who periodically opens and closes a control valve to cause hydraulic cylinder elongation. After a specified period, the operator again pulses the control valve to extend the cylinder.

Such manual operation is ineffective to discharge uniformly sized volumes of material since it is difficult for an individual to accurately control the time during which the control valve is open. Moreover, the individual must compensate for variable extension rates of the various cylinder stages. In addition, manual methods must rely on human accuracy and attentiveness to provide consistently regular time delays between elongation intervals. Aside from the inherent variations accompanying manual operation, a fundamental disadvantage is the presence of a human operator to actuate the cylinder. The presence of a workman is disadvantageous as it necessitates a concomitant salary expense and requires a tedious repetitive task to be performed.

To provide additional flexibility in a control adapted for use with a constant flow rate pump, it is desirable to be able to adjust the time delay between elongation increments as well as to vary the length increments through which a cylinder extends. Neither of these features are, at present, known in hydraulic cylinder control apparatus. Accordingly, it is seen that a need continues to exist for a truly effective control for an hydraulic cylinder which is connected to a constant volume flow rate pump.

OBJECTS AND SUMMARY OF THE INVENTION

One object of the present invention is to provide a novel hydraulic cylinder control which intermittently advances an hydraulic cylinder at an essentially constant rate.

Another object of the invention is to provide an hydraulic cylinder control for a telescopic hydraulic cylinder which automatically compensates for variable rates of elongation in the various stages.

A further object of the invention is to provide an hydraulic cylinder control which intermittently advances the cylinder and which has a variable time delay between consecutive invariant length increments.

Another object of the present invention is to provide an hydraulic cylinder control for an hydraulic cylinder in which the magnitude of the length increment can be varied as well as a variable time delay interposed between consecutive invariant length increments.

A still further object of the present invention is to provide a method of intermittently operating an hydraulic cylinder such that its rate of elongation is essentially constant with respect to time.

An hydraulic cylinder control that accomplishes the objects set forth above, as well as many others, includes an electrically actuated valve which may be interposed between an hydraulic cylinder and a constant flow rate supply of pressurized hydraulic fluid to regulate the admission of pressurized fluid into the cylinder.

The control includes a time delay assembly to control the time interval between adjacent length increments. The time delay assembly includes a resettable timer circuit having a continuously variable adjustment. The variable adjustment for the timer circuit allows an operator to set the time interval to be interposed between adjacent length increments and thus adjust the total time required to extend a cylinder. The timer circuit generates a pulse at the end of the selected time interval which resets a second time delay assembly to enable the valve.

The second time delay assembly includes a second resettable timer circuit having a plurality of selectable time periods and is operable to establish fluid communication between the pressurized fluid supply and the hydraulic cylinder. At the end of a selected time period, the second timer circuit disables the valve and generates a pulse which resets the first timer circuit. The first timer circuit then interposes the time delay before the second timer circuit is reset again.

The discrete time periods of the second timer circuit are useful in regulating the valve such that successive stages of a telescoping hydraulic cylinder undergo uniform length increment changes. Alternatively, the discrete time delays may provide variable length increments for a single stage hydraulic cylinder so that length increment size may be varied.

BRIEF DESCRIPTION OF THE DRAWINGS

A preferred embodiment of the present invention is illustrated in the accompanying drawings wherein.

DESCRIPTION OF THE PREFERRED EMBODIMENTS

Figure 1:
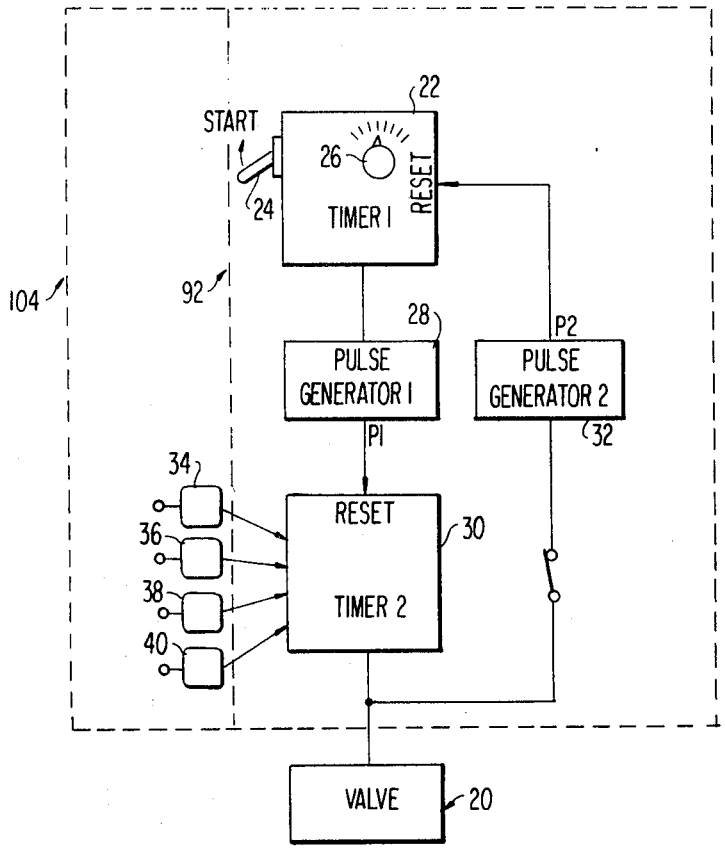
FIG. 1 is a schematic illustration of the hydraulic cylinder control.

Turning now to FIG. 1, a suitable conventional electrically actuated valve 20 comprises an element of an hydraulic cylinder control system according to this invention. The valve 20 may, for example, be a solenoid valve and is controlled by a circuit which includes a suitable conventional first timer circuit 22 having a starting switch 24, a continuously variable time delay adjustable by a knob 26 and a reset terminal. The first timer circuit 22 may, for example, be an RC timing network. The first timer circuit 22 is one portion of a first timer assembly that also includes a suitable conventional pulse generator circuit 28 as a second portion.

The pulse generator circuit 28 generates a pulse P1 when the first timer circuit 22 reaches the end of a time interval set by the adjustment knob 26. The pulse P1 is communicated to a second timer assembly comprising a suitable conventional second timer circuit 30 and a suitable conventional pulse generator 32. The second timer circuit 30 includes a plurality of selectable discrete time periods and may, for example, be an RC timing network. The pulse generator 32 generates a start pulse P2 when the time period of the second timer circuit 30 expires.

Each of the plurality of predetermined time periods of the second timer circuit 30 may be selected in a suitable manner such as by a corresponding one of a plurality of suitable conventional switches 34, 36, 38, 40. The second timer circuit 30 is operatively connected to the valve 20 such that the valve 20 is open when the timer circuit 30 counts a time period.

Figure 2:
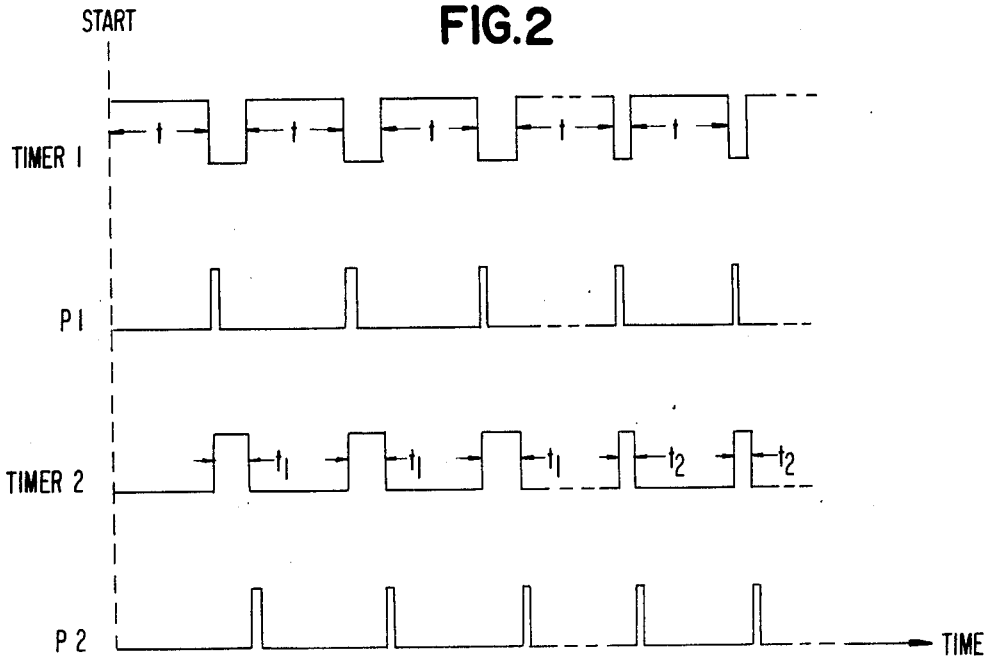
FIG. 2 is a timing diagram for the hydraulic cylinder control of FIG. 1.

To understand the operation of the hydraulic cylinder control system of FIG. 1, the timing diagram of FIG. 2 is helpful. More particularly, when the start switch 24 is initiated, the first timer circuit 22 is triggered and counts for a time interval $t$. At the end of the time interval $t$, the pulse generator 28 generates the pulse P1 which resets and triggers the second timer circuit 30. The second timer circuit 30 opens the valve 20 throughout a time period $t_1$. At the end of the time period $t_1$, the second pulse generator 32 generates a start pulse P2 which resets and triggers the first timer circuit 22. With the beginning of a new time interval $t$, the control cycle starts again.

To determine the proper time period for an hydraulic cylinder to be regulated such that cylinder elongation is intermittent and an essentially constant function with respect to time, the length of the cylinder stroke is subdivided into a plurality of equal length intervals. For any particular hydraulic cylinder, knowing a length increment and the flow capacity of a constant flow rate pump supplying hydraulic fluid to the cylinder, the time period can readily be determined during which hydraulic fluid must be admitted to the cylinder so that the cylinder extends a distance equal to one length increment. The selected time period is then set in the second timer circuit 30. Accordingly, each time the second timer circuit 30 is operative, the valve 20 is open and the cylinder will extend through one length increment.

As it may be desired to provide a plurality of different size length increments for the hydraulic cylinder control system, the switches 34, 36, 38, 40 may be used to select different time periods for the second timer circuit 30 which time periods correspond to the plurality of different length increments.

The time interval between consecutive length increments is determined by the first timer circuit 22 as noted above. The adjustment knob 26 of the first timer 22 is used to select the desired time interval between length increments. As the first and second timer circuits iterate to cyclically advance the hydraulic cylinder and then delay advancement for specified time interval, the cylinder is intermittently extended to the length of one stroke. Thus, by controlling the time interval between length increments, the overall time required to completely extend an hydraulic cylinder may be varied. More specifically, the time periods during which the length increments occur will require the same total length of time regardless of any time delay interval interposed between consecutive length increments. Variation of the duration of the time interval interposed between successive length increments causes a corresponding proportionate variation in the total time needed to extend the cylinder.

Figure 3:
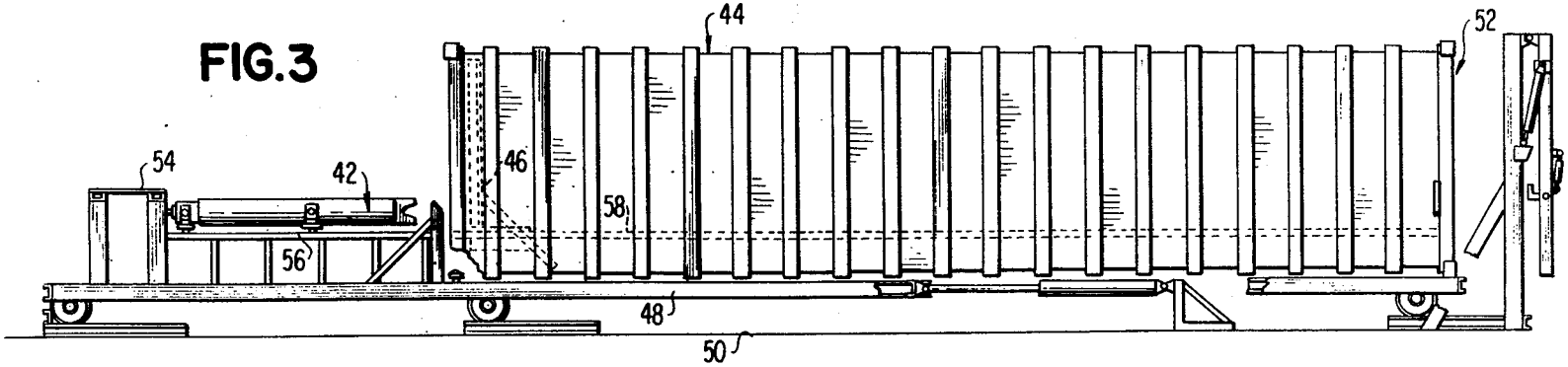
FIG. 3 is an elevational view of refuse container unloading apparatus with an hydraulic cylinder control in accordance with the present invention operating a telescopic hydraulic cylinder.

Turning now to FIG. 3, a telescoping hydraulic cylinder 42 is illustrated that is adapted to enter an open end of a refuse container 44 and push against a slidable bulkhead or platen assembly 46. The container 44 may be mounted on a carriage assembly 48 for limited longitudinal reciprocation with respect to a supporting surface 50. The container 44 includes a horizontally hinged tailgate assembly 52 which may be opened to permit discharge of the refuse material therefrom. The container 44 is adapted to contain solid refuse material which characteristically has non-uniform particle size heterogeneous material composition, and various textures.

When dealing with material of variable size and composition, a uniform rate of container discharge is difficult to accomplish. A uniform discharge rate is especially important where the refuse is discharged for use as fuel in a power generating facility. Besides the desirability of uniform discharge rates, it is advantageous to be able to control the total time necessary to empty the container so that the fuel supply rate can be regulated.

With low discharge rates, the random combinations of size, composition and texture manifest themselves as exaggerated irregularities in the discharge rate. At higher discharge rates, however, the irregularities are far less pronounced. The flow regularity advantage of higher discharge rates and the desirability of total discharge time control can be simultaneously obtained in an intermittently extended hydraulic cylinder. Accordingly, the hydraulic cylinder 42 is preferably designed for intermittent elongation and the contents of the container may thus be discharged at an essentially uniform rate with respect to time.

The cylinder 42 is connected at one end to a vertically upstanding portion 54 of the frame assembly 48 and is supported during part of its stroke by guides 56 carried by the carriage assembly 48. As the cylinder extends into the container 44, the cylinder 42 is supported by longitudinal guides 58 disposed inside the container and in general longitudinal alignment with the guides 56 connected to the frame assembly 48.

Figure 4:
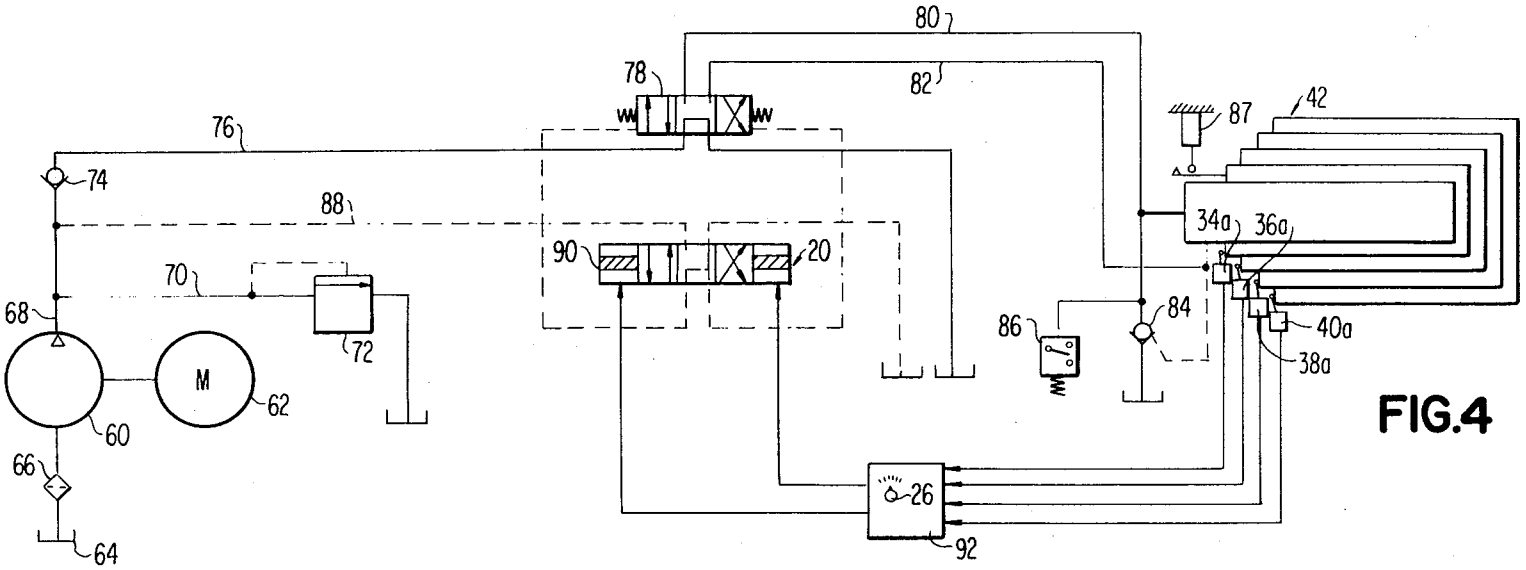
FIG. 4 is an electro-hydraulic circuit for the container unloading apparatus of FIG. 3.

A suitable conventional constant flow hydraulic pump 60 (FIG. 4) is driven by a conventional motor 62 and supplies pressurized fluid to an hydraulic pressure system. The pump 60 draws unpressurized fluid from a reservoir 64, through a filter 66, and discharges pressurized fluid to a pressure manifold 68. The pressure manifold 68 may be provided with a branch conduit 70 having a pilot operated relief valve 72 therein. The relief valve 72 limits the maximum hydraulic pressure within the manifold 68 by venting any excess pressure back to tank.

The manifold 68 may also include a suitable conventional check valve 74 which maintains pressure in a downstream portion 76 of the hydraulic circuit in the event hydraulic pressure from the pump 60 should fail. In this manner, the inadvertent loss of hydraulic control is minimized. The downstream portion 76 of the hydraulic circuit includes a pressure actuated control valve 78 which governs the flow of hydraulic fluid into conduits 80, 82 which communicate respectively with first and second actuating chambers of the telescopic hydraulic cylinder 42.

The conduit 80 may be provided with a suitable conventional pilot operated check valve 84 which operates in response to pressure in the other conduit 82 to allow discharge of fluid from one actuating cylinder to a tank. The pilot operated valve 84 accommodates the unequal flow rates of hydraulic fluid on the opposing side of the hydraulic cylinder 42 during the retraction stroke. A suitable conventional pressure switch 86 may be provided in conduit 80 to provide an indication of the pressure level existing in conduit 80. A limit switch 87 may be positioned so that it is tripped by a follower connected to the last stage of the cylinder 42.

The pressure switch 86, in combination with the limit switch 87, may be interconnected so that the cylinder trips the limit switch 87 at the end of a stroke and the cylinder pressure reaches a specified value at the end of the stroke thereby indicating that the stroke is complete. The pressure switch 86 is operable to indicate the presence of a blockage or restraint on the cylinder 42 if the specified pressure value is attained but the limit switch 87 is not tripped.

Pressure for operating the control valve 78 is supplied through a pilot pressure conduit 88 to a pilot pressure control valve 90 which may be a suitable conventional solenoid valve. The solenoid valve 90 is electrically actuated by the hydraulic control 92 illustrated and discussed in connection with FIG. 1.

With a telescoping hydraulic cylinder 42, compensation must be made for the variable rates at which successive stages of the cylinder extend when supplied with hydraulic fluid at a constant flow rate and pressure. Accordingly, a limit switch **34*a*, 36*a*, 38*a*, and 40*a* is provided for each of the corresponding stages. As each successive stage of the hydraulic cylinder 42 becomes active, the associated limit switch indicates this fact by sending a signal to the hydraulic cylinder control 92. The limit switches alter the time period set in the second timer circuit 30 (see FIG. 1) such that, for each successive stage of the cylinder 42, the valve 90 will be opened for an appropriate brief interval to provide equal length increments for each of the successive stages. The hydraulic cylinder control 92 controls the actuation of the solenoid pilot valve 90 which controls the flow of pilot pressure to the main hydraulic control valve 78 which in turn controls the flow of hydraulic fluid to the cylinder 42** itself.

Figure 5:
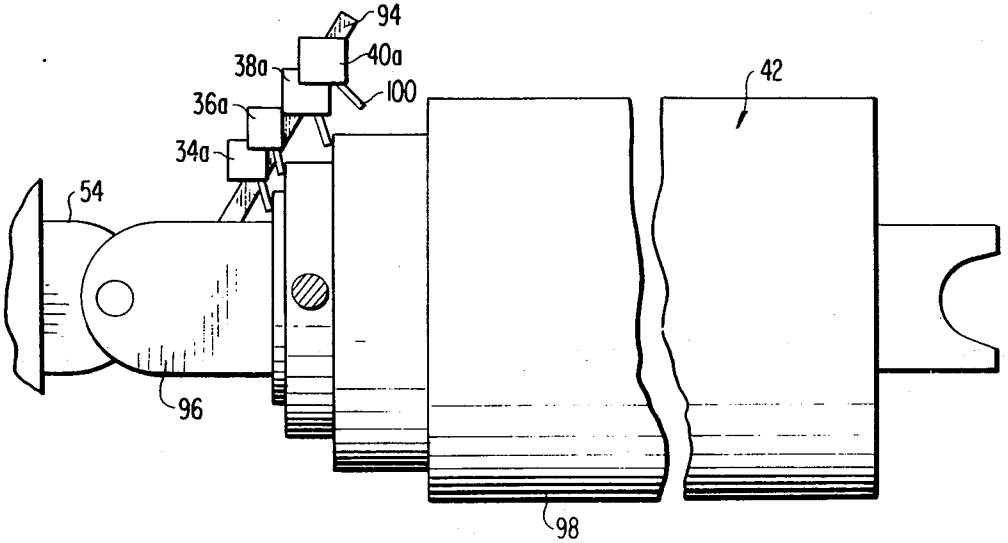
FIG. 5 is an enlarged view of the hydraulic cylinder in FIG. 1 illustrating the stage indication apparatus.

Since larger diameter stages of a telescopic hydraulic cylinder become active first, the limit switches **34*a*, 36*a*, 38*a*, 40*a* (see FIG. 5) may be mounted on a suitable bracket 94 carried by the relatively small diameter rod portion 96 of the hydraulic cylinder. Accordingly, as the first and largest diameter stage 98 of the hydraulic cylinder 42 becomes active it moves away from the vane 100 of the limit switch 40*a* and triggers a particular time period for the second timer circuit 30. As successively smaller diameter stages become active, the vanes of the remaining limit switches are released causing changes in the time period set by the second timer 30**.

Figure 6:
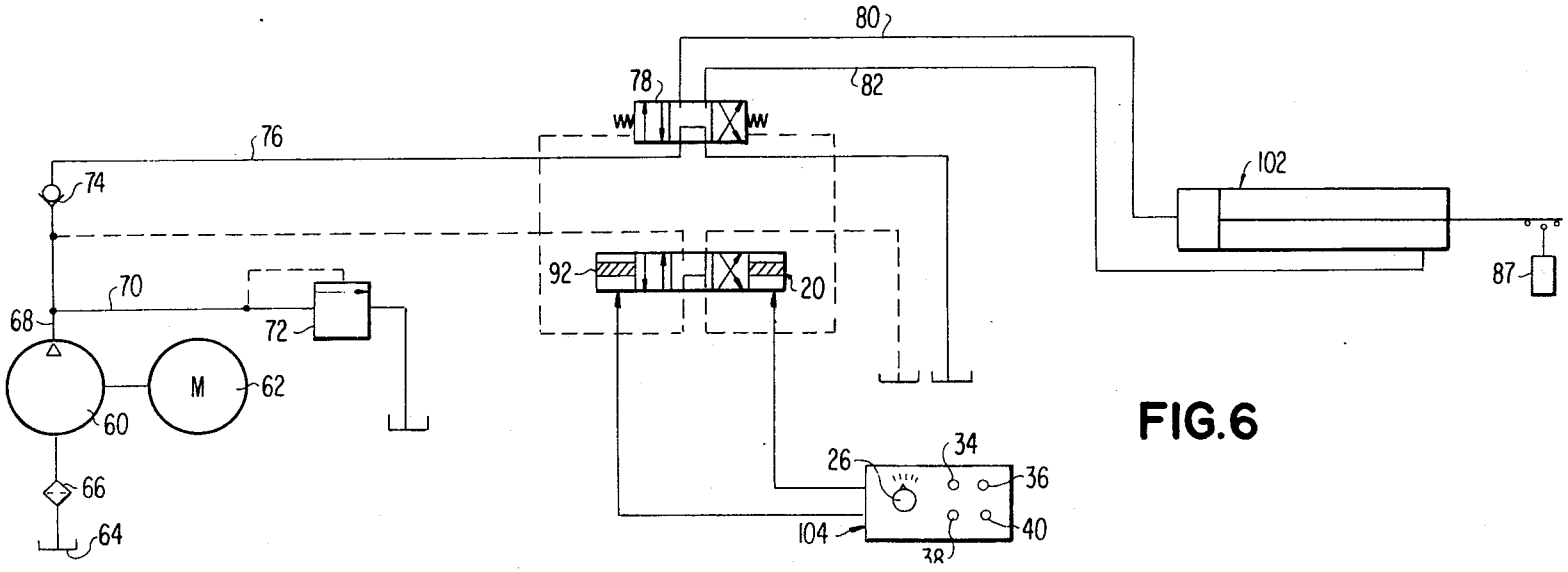
FIG. 6 is an electro-hydraulic diagram similar to FIG. 4 for a single stage hydraulic cylinder.

Turning now to FIG. 6 a second embodiment of the invention is illustrated in which a single stage double-acting hydraulic cylinder 102 is regulated. The components and operation of the hydraulic system in FIG. 6 are similar in all respects to the operation of the hydraulic circuit in FIG. 4 except for the presence of a single stage hydraulic cylinder 102 and a modified form of the hydraulic cylinder control 104. The modified form of the hydraulic cylinder control 104 includes suitable conventional switches 34, 36, 38, 40 rather than limit switches, as described in connection with FIG. 4.

The switches 34, 36, 38, 40 are used to select the length increment through which the single stage hydraulic cylinder 102 is to be extended. A particular length increment may be selected, for example, by actuating the switch 34 so that a corresponding time period is set for the second timer circuit 30 (FIG. 1). The time interval between successive length increments is adjusted by the knob 26 which controls the time interval set by the first timer circuit 22. Variation of the size of the length increments results in a corresponding increase or decrease in the number of cycles required to complete a stroke of the cylinder 104. Thus length increment size as well as the time interval between successive length increments can be varied in order to adjust the total time required to extend the cylinder.

Operation of the hydraulic cylinder control 92 with the single stage cylinder 102 of FIG. 6 results in the cylinder 102 being extended through a plurality of successive intermittent length increments, each of which is spaced by a time delay interval, *t*. The desired time delay interval *t* is selected by adjusting the knob 26 (see FIG. 1) of the first timer circuit 22. Then, the first timer circuit 22 is first initiated by actuating the start switch 24 so that the desired time delay interval *t* is timed.

At the end of the time delay interval, the first pulse generator 28 generates a first pulse P1 which is communicated to the reset terminal of the second timer circuit 30. The first pulse P1 is also communicated to the control valve 20 and opens the valve 20. The valve 20 controls the flow of pilot pressure to the main control valve 78 which, in turn, controls the flow of hydraulic fluid to the cylinder 102. Thus, opening the valve 20 gives a corresponding opening to the main hydraulic valve 78 so that the cylinder 102 can extend.

When the second timing circuit 30 is reset, it counts until the end of a selected time period $t_1$. The time period $t_1$ is selected by moving a desired one of the switches 34, 36, 38, 40. When the second timing circuit 30 has reached the end of the selected time period, the second pulse generator 32 (see FIG. 1) generates a start pulse P2. At the same time, the valve 20 closes thereby closing the main valve 78 (FIG. 6) and stopping extension of the cylinder 102. The start pulse P2 communicates with the reset terminal of the first timing circuit 22 (see FIG. 1) and triggers the beginning of a new time delay interval, *t*.

Thus, the hydraulic cylinder 102 (FIG. 6) extends while the main valve 78 is open, i.e., during the time period $t_1$, and movement of the cylinder 102 is interrupted while the main valve 78 is closed, i.e., during the time delay interval, *t*. The foregoing procedure is repeated so that the cylinder extends through a plurality of length increments.

The operation of the control 92 as applied to a multi-stage cylinder 42 (see FIG. 4) follows the procedure as outlined above. However, at the end of each stage of the multi-stage cylinder, there is a corresponding limit switch 34*a*, 36*a*, 38*a*, 40*a*, each of which is connected to the second timing circuit 30 so as to appropriately alter the time period. As each successive stage of the cylinder 42 becomes active, the corresponding limit switch switches the second timing circuit to a different time period.

The use of the present hydraulic cylinder control with a single stage cylinder would enable an operator to select an overall time in which the cylinder would extend and then vary the length increment and the time interval to accomplish cylinder extension in the selected overall time. The flexibility would be provided in the quantity of material pushed from a refuse container during each cycle of the cylinder control.

While the hydraulic cylinder control described above can be used to regulate an hydraulic cylinder during both extension and retraction strokes, the control may be used to control either the extension stroke or the retraction stroke by connecting the control in parallel with a valve solenoid actuating circuit so that a suitable switch would select either the intermittent control or the continuous solenoid actuating circuit. In this manner, the intermittently extended stroke could be retracted at full speed to avoid unnecessary delays.

To provide independent adjustability for both an intermittent extension stroke and an intermittent retraction stroke, a double solenoid control valve could have one solenoid controlled by a first circuit 104 and the second solenoid controlled by a second circuit identical to the first circuit. In this manner, the extension and retraction strokes would be independently adjustable.

The preferred embodiment for the disclosed use of the control is to provide intermittent extension of the multi-stage hydraulic cylinder and to provide continuous retraction thereof. In each of the control variations discussed above, the transition between an extension stroke and a retraction stroke may be effected with a suitable conventional limit switch.

It is now apparent that an hydraulic cylinder control constructed in accordance with the foregoing specification substantially accomplishes the objects set forth, as well as others. It will also be apparent to those skilled in the art that there are numerous variations, substitutions, modifications and equivalents of the features comprising this invention. Accordingly, it is expressly intended that all such variations, substitutions, modifications and equivalents which fall within the spirit and scope of the invention as defined in the claims be embraced thereby.

What is claimed is:

1. A method of controlling the extension of a multi-stage hydraulic cylinder through a plurality of successive uniform length increments comprising the steps of:

selecting a time delay between successive length increments by adjusting a first timer;

interrupting extension of the hydraulic cylinder for a time corresponding to the selected time delay;

extending the hydraulic cylinder through one length increment by controlling a valve with a second timer;

sequentially repeating the interrupting and extending steps until the cylinder is extended to a predetermined length exceeding the one length increment:

wherein the step of interrupting includes initiating the first timer in response to a start signal and generating a pulse at the end of the selected time delay;

wherein the step of extending includes, starting the second timer and opening the valve in response to the pulse, and closing the valve and generating the start signal when the second timer reaches a time corresponding to one length increment; and further including the step of switching the second timer to a different time as each successive stage of the hydraulic cylinder becomes active.

2. Apparatus comprising:

hydraulic cylinder means having a plurality of stages;

valve means communicating with the cylinder means, having an open position for admitting pressurized fluid to the cylinder means and a closed position preventing fluid from entering the cylinder means;

first timer means having adjustment means for preselecting a time delay between successive length increments, means for starting the timer in response to a start signal, and operable to generate a pulse at the end of the time delay;

second timer means having a set time interval, connected with the first timer means and the valve means, initiated by the pulse, operable to place the valve means in the open position while the set time interval elapses, and operable to generate the start signal at the end of the set time interval; and further including indicator means at an end of the cylinder means, connected to the second timer means, and operable to select the set time interval from a plurality of possible time intervals such that the second timer means is adjusted to compensate for different stages of the cylinder means.

3. The apparatus of claim 2 wherein the indicator means includes a plurality of limit switches, each limit switch positioned with a corresponding stage of the cylinder means and being tripped when the corresponding stage moves.

4. The apparatus of claim 3 wherein the set time interval corresponding to each stage of the cylinder means is predetermined so that each stage extends through a plurality of length increments and the length increment of each stage is essentially the same as the length increment for each other stage.

5. A method of controlling the extension of an hydraulic cylinder through a plurality of successive length increments comprising the steps of:

selecting a delay interval between successive length increments by adjusting a first timer;

extending the hydraulic cylinder through a first length increment;

interrupting extension of the hydraulic cylinder for a time corresponding to the selected delay interval;

sequentially repeating the extending and interrupting steps until the cylinder is extended to a predetermined length exceeding the first length increment;

selecting one of a plurality of elongation time periods which corresponds to the time necessary to extend the hydraulic cylinder through the first length increment during extension through the first predetermined length;

selecting a different one of the plurality of elongation time periods which corresponds to the time necessary to extend the hydraulic cylinder through a second length increment during extension through a second predetermined length exceeding the first predetermined length; and wherein selection of the different one of the plurality of time periods is effected by actuating a limit switch between the first predetermined length and the second predetermined length.

* * * * *